US010815592B2

(12) United States Patent
Gretton et al.

(10) Patent No.: US 10,815,592 B2
(45) Date of Patent: Oct. 27, 2020

(54) THERMAL INSULATING STRUCTURE

(71) Applicant: adidas AG, Herzogenaurach (DE)

(72) Inventors: Julie Caroline Gretton, Herzogenaurach (DE); John Rutledge, Leicestershire (GB); Stephen John Russell, Harrogate (GB); Vera Chetty, Mirfield (GB); Matthew James Tipper, York (GB)

(73) Assignee: adidas AG, Herzogenaurach (DE)

( * ) Notice: Subject to any disclaimer, the term of this patent is extended or adjusted under 35 U.S.C. 154(b) by 290 days.

(21) Appl. No.: 15/833,477

(22) Filed: Dec. 6, 2017

(65) Prior Publication Data

US 2018/0155859 A1 Jun. 7, 2018

(30) Foreign Application Priority Data

Dec. 6, 2016 (DE) ..... 10 2016 224 251

(51) Int. Cl.
*D04H 1/556* (2012.01)
*D04H 1/4391* (2012.01)
(Continued)

(52) U.S. Cl.
CPC ..... *D04H 1/556* (2013.01); *A47G 9/0207* (2013.01); *A47G 9/086* (2013.01); *D04H 1/4258* (2013.01);
(Continued)

(58) Field of Classification Search
CPC .. D04H 1/4258; D04H 1/4266; D04H 1/4382; D04H 1/4391; D04H 1/54; D04H 1/541; D04H 1/556; D04H 1/724; A47G 9/0207; A47G 9/086; B68G 2001/005; A41D 3/00; A41D 2400/10
See application file for complete search history.

(56) References Cited

U.S. PATENT DOCUMENTS 4,167,604 A * 9/1979 Aldrich ..... A47G 9/0207 252/62
4,426,945 A 1/1984 A-Yan
(Continued)

FOREIGN PATENT DOCUMENTS

AU 2003204527 12/2004
CN 1535340 10/2004
(Continued)

OTHER PUBLICATIONS

German Application No. 102016224251.2, Office Action dated Dec. 21, 2017, 13 pages (includes English machine translation).
(Continued)

*Primary Examiner* — David R Hare
(74) *Attorney, Agent, or Firm* — Kilpatrick Townsend & Stockton LLP

(57) ABSTRACT

The present invention relates to a thermal insulating structure including at least one baffle, to an article of wear and a sleeping bag including such a thermal insulating structure, and to a method for manufacturing such a thermal insulating structure. In some embodiments, the baffle includes a plurality of natural and/or synthetic down fibers and a plurality of low-melt fibers, wherein the low-melt fibers have been melted to the natural and/or synthetic down fibers by heating inside the baffle.

18 Claims, 2 Drawing Sheets

(51) Int. Cl.

| | |
|---|---|
| ***A47G 9/02*** | (2006.01) |
| ***D04H 1/54*** | (2012.01) |
| ***A47G 9/08*** | (2006.01) |
| ***D04H 1/4266*** | (2012.01) |
| ***D04H 1/4382*** | (2012.01) |
| ***D04H 1/4258*** | (2012.01) |
| ***D04H 1/724*** | (2012.01) |
| *B68G 1/00* | (2006.01) |
| *A41D 3/00* | (2006.01) |

(52) U.S. Cl.
CPC ..... *D04H 1/4266* (2013.01); *D04H 1/4382* (2013.01); *D04H 1/4391* (2013.01); *D04H 1/54* (2013.01); *D04H 1/724* (2013.01); *A41D 3/00* (2013.01); *A41D 2400/10* (2013.01); *B68G 2001/005* (2013.01)

(56) References Cited

U.S. PATENT DOCUMENTS

| | | | | |
|---|---|---|---|---|
| 4,588,635 | A * | 5/1986 | Donovan | D04H 1/4391 428/6 |
| 4,693,917 | A * | 9/1987 | Geloen | D06M 19/00 428/6 |
| 4,992,327 | A * | 2/1991 | Donovan | A41G 11/02 428/198 |
| 5,064,703 | A * | 11/1991 | Frankosky | D06M 15/507 2/87 |
| 5,344,707 | A * | 9/1994 | Snyder | A47G 9/00 428/359 |
| 5,382,153 | A * | 1/1995 | Nettelnstroth | A61F 13/2082 156/166 |
| 5,437,909 | A * | 8/1995 | Herzberg | D04H 1/02 428/192 |
| 5,443,893 | A * | 8/1995 | Herzberg | B32B 5/26 428/198 |
| 5,710,080 | A * | 1/1998 | Pellegrini | B32B 5/08 442/304 |
| 6,025,041 | A * | 2/2000 | Reuben | A47G 9/0207 428/15 |
| 6,232,249 | B1 * | 5/2001 | Kawada | A47G 9/007 428/332 |
| 7,351,463 | B2 * | 4/2008 | Chen | A47G 9/0207 19/65 R |
| 2002/0034637 | A1 | 3/2002 | Yoshioka et al. | |
| 2004/0126580 | A1 * | 7/2004 | Gaignard | D04H 1/4266 428/373 |
| 2005/0124256 | A1 | 6/2005 | Mason et al. | |
| 2006/0076106 | A1 | 4/2006 | McGuire | |
| 2007/0194477 | A1 | 8/2007 | Gaignard et al. | |
| 2011/0094004 | A1 * | 4/2011 | Li | A47G 9/02 2/69 |
| 2014/0141179 | A1 * | 5/2014 | Pavlos | D06M 10/025 428/16 |
| 2014/0193620 | A1 | 7/2014 | Sandoe et al. | |
| 2014/0206796 | A1 * | 7/2014 | Allampalayam Jayaraman | D06M 10/025 523/207 |
| 2015/0196145 | A1 * | 7/2015 | Reuben | D04H 1/541 5/502 |
| 2017/0172240 | A1 * | 6/2017 | Massey | B32B 5/26 |

FOREIGN PATENT DOCUMENTS

| | | |
|---|---|---|
| CN | 204510665 | 7/2015 |
| DE | 2139023 | 2/1972 |
| DE | 60225915 | 4/2009 |
| DE | 102008035621 | 11/2009 |
| DE | 102014002060 | 8/2015 |
| EP | 0279677 | 8/1988 |
| EP | 0600844 | 6/1994 |
| JP | S594734 | 1/1984 |
| JP | 59105486 | 6/1984 |
| JP | 60111681 | 6/1985 |
| JP | S61213087 | 9/1986 |
| JP | 0931835 | 2/1997 |
| JP | 2007125153 | 5/2007 |
| JP | 2010029655 | 2/2010 |
| JP | 2013177701 | 9/2013 |
| JP | 2014080720 | 5/2014 |
| JP | 2018071019 | 5/2018 |
| WO | 9641560 | 12/1996 |
| WO | 2016035255 | 3/2016 |
| WO | 2016073691 | 5/2016 |

OTHER PUBLICATIONS

European Application No. 17205384.5, Office Action dated Jun. 14, 2019, 4 pages.
European Application No. 17205384.5, Extended European Search Report dated Feb. 5, 2018, 9 pages.
Japanese Application No. 2017-234311, Office Action dated Mar. 5, 2019, 11 pages (6 pages of the original document and 5 pages of the English translation).
Dahiya et al., "Melt Blowing Technology", Available on internet at: https://web.archive.org/web/20120216211234/http://web.utk.edu/~mse/Textiles/Melt%20Blown%20Technology.htm, 2004, 12 pages.
German Patent Application No. 102016224251.2, Office Action dated Jul. 21, 2017, 8 pages (No English translation available. A summary of the Office Action is provided in the accompanying transmittal).
Japanese Application No. 2017234311, Office Action dated Oct. 23, 2019, 10 pages (5 pages of translation and 5 pages of Original document).
Chinese Application No. 201711274453.3, Office Action dated Dec. 5, 2019, 13 pages (7 pages of translation and 6 of Original document).
European Patent Application No. 17205384.5, Office Action dated Mar. 23, 2020, 5 pages.
Japanese Patent Application No. 2017-234311, Appeal Reconsideration Report dated, Jun. 1, 2020, 10 pages (English machine translation provided).
Japanese Patent Application No. JP2017-234311, Office Action dated Sep. 8, 2020, 28 pages (English machine translation provided).

* cited by examiner

THERMAL INSULATING STRUCTURE

CROSS REFERENCE TO RELATED APPLICATION

This application is related to and claims priority benefits from German Patent Application No. DE 10 2016 224 251.2, filed on Dec. 6, 2016, entitled THERMAL INSULATING STRUCTURE ("the '251.2 application"). The '251.2 application is hereby incorporated herein in its entirety by this reference.

FIELD OF THE INVENTION

The present invention relates to a thermal insulating structure comprising at least one baffle, to an article of wear and a sleeping bag comprising such a thermal insulating structure, and to a method for manufacturing such a thermal insulating structure.

BACKGROUND

Clusters of down feathers are well known as a warm, lightweight and packable material for filling into garments such as a jacket or into a duvet for winter. The loose structure of down feathers traps air, which helps to insulate a wearer against heat loss. If well cared for, they retain their loft up to three times longer than do most synthetics. However, when down feathers are wet, their thermal properties are virtually eliminated. Down feathers form clumps if exposed to dampness or moisture, and will mildew if left damp. In addition, they will absorb and retain odors.

As a counter measure in order to mimic the thermal properties of down feathers, combinations of synthetic fibers with low-melt fibers are known in the art. Various methods for manufacturing thermal insulating materials are known from AU2003204527 A1, EP0279677 A2, US 2005/0124256 A1, EP0600844 A1, US 2014/0193620 A1 and from a publication of Dahiya et al. (c.f. e.g. http://www.engr.utk.edu/mse/Textiles/Melt%20Blown%20Technology.htm).

The US 2006/0076106 A1 discloses a process for making a high loft, nonwoven material by providing either natural and/or synthetic fibers, providing a low-melt binder fiber, mixing the low-melt binder fiber and the natural and/or synthetic fibers to form a web, cross-lapping the web, drafting the web with a drafter, heating the drafted web to a temperature sufficient to melt the low-melt binder fibers, and cooling the web thereby forming a structural nonwoven material.

However, such thermal insulating materials have limitations and may not be able to provide thermal and lightweight properties to an acceptable level. This is especially true for textiles, e.g. of jackets, having a plurality of baffles, in which the synthetic fibers and/or down fibers are placed.

Therefore, the objective of the present invention is to provide an improved structure for providing improved thermal and lightweight properties in order to at least partly overcome the above mentioned deficiencies of the prior art.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a thermal insulating structure comprising at least one baffle, the baffle comprising: a plurality of at least one of a natural down fibers and a synthetic down fibers; and a plurality of low-melt fibers, wherein the plurality of low-melt fibers have been melted to the plurality of at least one of the natural down fibers and the synthetic down fibers by heating inside the baffle.

In certain embodiments, the plurality of low-melt fibers are adapted to secure the plurality of at least one of the natural down fibers and the synthetic down fibers inside the baffle.

In some embodiments, the plurality of low-melt fibers melted to the plurality of at least one of the natural down fibers and the synthetic down fibers are adapted to provide a higher thermal insulation per weight compared to synthetic down fibers.

The plurality of low-melt fibers melted to the plurality of at least one of the natural down fibers and the synthetic down fibers, in certain embodiments, are adapted to provide a higher dry compression recovery compared to synthetic down fibers.

The plurality of low-melt fibers, in some embodiments, have been carded with the plurality of at least one of the natural down fibers and the synthetic down fibers into a web structure before heating inside the baffle.

In certain embodiments, the web structure has been changed from a loose structure to a set 3D structure by cooling the melted plurality of low-melt fibers inside the baffle.

In some embodiments, the plurality of low-melt fibers comprises low-melt core-sheath fibers.

The plurality of low-melt fibers, in certain embodiments, is provided as a filament having a linear mass density of 0.1-10 dtex.

The plurality of at least one of the natural down fibers and the synthetic down fibers, in some embodiments, comprises at least one hollow fiber.

In certain embodiments, the thermal insulating structure forms an article of wear.

In some embodiments, the thermal insulating structure forms a sleeping bag.

According to certain embodiments of the present invention, a method for manufacturing a thermal insulating structure comprising the steps of: forming at least one baffle; filling a plurality of at least one of a natural down fibers and a synthetic down fibers into the baffle; filling a plurality of low-melt fibers into the baffle; and heating the fibers inside a filled baffle.

In some embodiments, the method further comprising the step of mixing the plurality of at least one of the natural down fibers and the synthetic down fibers and the plurality of low-melt fibers before filling the baffle.

In certain embodiments, the method further comprising the step of blowing the plurality of at least one of the natural down fibers and the synthetic down fibers and the plurality of low-melt fibers with compressed air.

The method, in some embodiments, further comprising the step of carding the plurality of at least one of the natural down fibers and the synthetic down fibers and the plurality of low-melt fibers into a web structure.

The method, in certain embodiments, further comprising the step of disassembling the web structure.

In some embodiments, the method further comprising the step of cooling the heated filled baffle.

In certain embodiments, wherein at least one of the filling steps is performed by a robotic device.

Heating, in some embodiments, comprises applying hot air.

Heating, in certain embodiments, comprises applying electromagnetic radiation.

BRIEF DESCRIPTION OF THE DRAWINGS

In the following detailed description, embodiments of the invention are described referring to the following figures.

BRIEF DESCRIPTION

Figure 1:
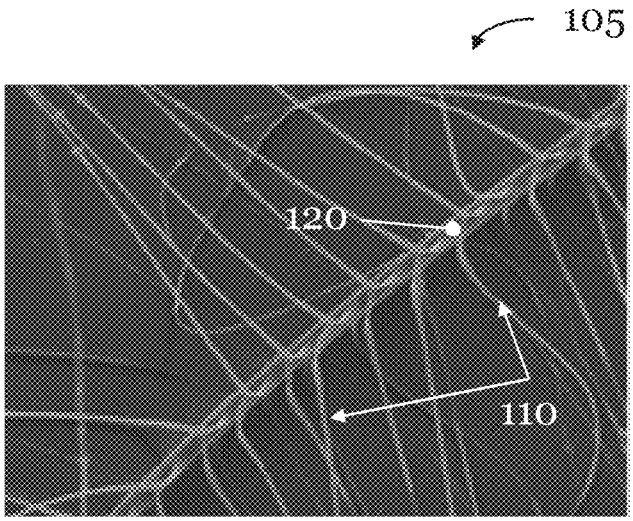
FIG. 1 is a diagram illustrating exemplary natural and synthetic down fibers according to certain embodiments of the present invention.
Figure 1:
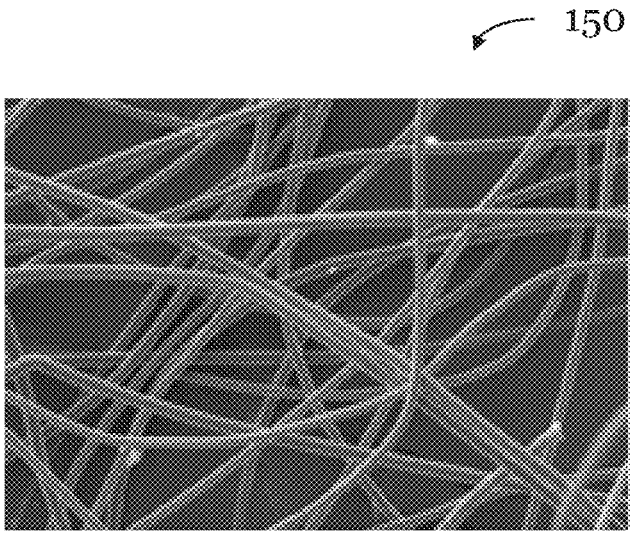

The above mentioned problem is at least partly solved by a thermal insulating structure including at least one baffle, wherein the baffle comprises a plurality of natural and/or synthetic down fibers and a plurality of low-melt fibers, wherein the low-melt fibers have been melted to the natural and/or synthetic down fibers by heating inside the baffle.

Whereas in the prior art mentioned above, materials with good thermal insulation and the ability to avoid clumps are provided by melting the low-melt fibers to the synthetic fibers, the present invention goes a significant step further. According to the invention, the low-melt fibers are melted to natural and/or synthetic down fibers by heating inside the baffle. Thus, such a thermal insulating structure may offer a greater freedom of baffle design compared to using conventional baffles, because bigger baffles or baffles of different sizes and shapes may be used. For example, conventional baffles for jackets just extend horizontally. Therefore, the present invention provides the possibility that smaller baffles for the shoulder regions may be manufactured with bigger baffles in the chest region of a wearer so that the jacket fits closely and tightly to the body of the wearer and may provide improved thermal insulating properties. Alternatively, in some embodiments, only two baffles may be formed, filled and heated so that the cycle time for manufacturing the jacket may be significantly reduced. Moreover, methods in the prior art create large planar sheets of synthetic insulation while the present invention creates a thermal insulating structure as a 3D structure within the baffle to obtain the optimal thermal and lightweight properties of down clusters.

In some embodiments, the low-melt fibers may be adapted to secure the natural and/or synthetic down fibers inside the baffle. In this case, undesired moving of the natural and/or synthetic fibers inside the baffle may be avoided as the melted low-melt fibers may solidify and may act as a binder in order to bond the natural and/or synthetic fibers to each other. Therefore, such embodiments may further improve the thermal insulating properties as the natural and/or synthetic down fibers are evenly distributed over the wearer's body surface.

In some embodiments, the low-melt fibers melted to the natural and/or synthetic down fibers may be adapted to provide a higher thermal insulation per weight compared to synthetic down fibers. In this case, the melted low-melt fibers may provide tiny branches of fibers so that their structure may trap more air molecules per density weight and an increased thermal insulation may be provided.

In some embodiments, the low-melt fibers melted to the natural and/or synthetic down fibers may be adapted to provide a higher dry compression recovery compared to natural and/or synthetic down fibers. As the melted low-melt fibers are hydrophobic, such embodiments may provide improved recovery properties from a wet state to a dry state compared to other fibers, e.g. natural down fibers, and may still provide, at the same time, excellent thermal insulating properties.

In some embodiments, the low-melt fibers may have been carded with the natural and/or synthetic down fibers into a web structure before heating inside the baffle. Additionally or alternatively, the low-melt fibers may be mixed with the natural and/or synthetic down fibers before carding, e.g. mechanical mixing by a robotic device and/or by hand, and may be blown with compressed air. Using compressed air may give the fiber mixture an ideal loft, e.g. for obtaining a 3D structure. Moreover, the web structure may have been changed from a loose structure to a set 3D structure by cooling the melted low-melt fibers inside the baffle. All of these embodiments follow the same idea of providing improved thermal insulating and lightweight properties as the structure of the fibers may be further optimized in view of trapping air molecules.

In some embodiments, the plurality of low-melt fibers may comprise low-melt core-sheath fibers. Such fibers are well known in the prior art and easy to handle for the heating process inside the baffle. They start to melt before the natural down fibers will be destroyed and/or the synthetic down fibers will start to melt so that a thermal insulating structure may be provided with excellent thermal properties which is also lightweight and durable.

In some embodiments, the plurality of low-melt fibers may be provided as a filament having a linear mass density of 0.1-10 dtex, in other embodiments, 0.5-7 dtex and, in still other embodiments, 1-5 dtex. The inventors have found that such low-melt fibers and filaments provide a good compromise between improved thermal insulating properties and flexibility for further processing, for example for manufacturing garments or duvets.

In some embodiments, the plurality of natural and/or synthetic down fibers may comprise at least one hollow fiber.

Hollow fibers have an internal cavity, which may extend along the hollow fiber and may trap more air molecules. Thus, hollow fibers may further improve the thermal insulating and lightweight properties of the structure.

According to another aspect, the present invention is directed to an article of wear and a sleeping bag comprising an insulating structure according to the invention.

According to still another aspect, the present invention is directed to a method for manufacturing a thermal insulating structure comprising the steps of providing at least one baffle; filling a plurality of natural and/or synthetic down fibers into the baffle; filling a plurality of low-melt fibers into the baffle and heating the fibers inside the filled baffle.

In some embodiments, the method may further comprise the step of mixing the plurality of natural and/or synthetic down fibers and the plurality of low-melt fibers before the filling steps. Moreover, the method may further comprise the steps of blowing the plurality of natural and/or synthetic down fibers and the plurality of low-melt fibers with compressed air and/or carding the plurality of natural and/or synthetic down fibers and the plurality of low-melt fibers into a web structure. Additionally or alternatively, any other suitable medium for blowing the fibers may be applied. Furthermore, the method may comprise the step of disassembling the web structure. Moreover, the method may further comprise the step of cooling the heated filled baffle. These embodiments follow the same idea of providing an optimized manufacture of a thermal insulating structure with improved thermal insulating and lightweight properties.

In some embodiments, at least one of the filling steps may be performed by a robotic device. Such embodiments may further improve an automation of the whole manufacturing process, and thus may reduce the cycle time.

In some embodiments, heating may comprise applying hot air. Moreover, heating may comprise applying electromagnetic radiation. Providing heat energy by heat convection in a gas or the use of radiation may be desirable as the manufacturing is performed without contact. This means that the filled baffles are not directly touched with the heat source and the manufacturing may still be optimized.

Any method and/or heat source known in the art that can accomplish this may be employed in the inventive method. Examples are the use of radiation (further details on this will follow below) or heat convection in a gas. Beneficially, hot air is not expensive, relatively easy to handle and provides the necessary temperature for heating the filled baffle.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Some embodiments and variations of the present invention are described in the following with particular reference to thermal insulating structures, such as textiles, comprising at least one baffle. However, the concept of the present invention may identically or similarly be applied to any article of wear, covering materials, such as duvets, or sports equipment, such as sleeping bags, requiring improved thermal insulation and lightweight properties. The thermal insulating structure according to the invention may be used for a variety of articles of wear including jackets, garments with hoods, wherein the thermal insulating structure may be arranged at least in part on the article of wear, may be embedded in the article of wear or may form at least a layer of the article of wear. For example, the thermal insulating structure may be embedded in or form at least a layer of a jacket. In addition, the thermal insulating structure may be embedded at least partially in a tent.

Moreover, for brevity, only a limited number of embodiments are described in the following. However, the skilled person will recognize that the specific features described with reference to these embodiments may be modified and combined differently and that certain aspects of the specific embodiments may also be omitted. Moreover, it is noted that the aspects described in the subsequent detailed description may be combined with aspects described in the above summary section.

FIG. 1 shows examples of microscopy pictures of a plurality of natural down fibers 105 and a plurality of synthetic down fibers 150. It has to be noted that any kind of natural fibers may be used such as: wool, kapok, and other seed fibers, leaf fibers, such as sansevieria, fique, sisal, banana or agave, bast or skin fibers, such as flax, jute, kenaf, industrial hemp, ramie, rattan, vine fibers, or fruit fibers, such as coconut, and stalk fibers, such as straws of wheat, rice, barley, and other crops including bamboo and grass as well as tree wood and animal fibers, such as animal hairs, silk fibers and avian fibers. Moreover, any kind of synthetic fibers may be used such as: Nylon, Modacrylic, Olefin, Acrylic, Polyester, Rayon artificial silk, Vinyon, Saran, Spandex, Vinalon, Aramids known as Nomex, Kevlar and Twaron, Modal, Dyneema/Spectra, PBI (Polybenzimidazole fiber), Sulfar, Lyocell, PLA, M-5 (PIPD fiber), Orlon, Zylon (PBO fiber), Vectran (TLCP fiber) made from Vectra LCP polymer, Derclon used in manufacture of rugs, Acrylonitrile rubber, glass fibers, metallic fibers, expanded polystyrene flakes, urea-formaldehyde foam resin, polyurethane foam, phenolic resin foam.

As may be seen in some embodiments, the natural down fibers 105 comprise tiny branches 110 extending from the feather staff 120. Again, these tiny branches 110 may trap air molecules and may provide the excellent thermal insulating properties as no heat loss due to the heat conduction occurs. Moreover, this structure may provide a higher density and thus a thicker insulation as well as a lower air permeability so that the thermal insulating properties are further increased.

As may be seen in some embodiments, the synthetic down fibers 150 are more loosely arranged compared to the natural down fibers 105. The synthetic down fibers 150 may comprise a polyester material which is known under the tradename "3M Thinsulate Featherless II". In some embodiments, other synthetic materials may also be used such as 3M Featherless I, Primaloft Lux, Primaloft Thermoplume, Molina Microrollo, Shinih HaloBall or any other suitable loose fill synthetic fiber as mentioned above and/or insulating material.

Synthetic down fibers 150 may be produced by various techniques, for example by a melt blown process. Such a nonwoven process is unique because it is used almost exclusively to produce microfibers rather than fibers having the size of normal structure fibers. The melt blown process may be a one-step process in which high-velocity air blows a molten thermoplastic resin from an extruder die tip onto a conveyor or take-up screen to form a fine fibrous and self-bonding web. Moreover, the melt blown process is similar to a spun bond process which converts resins to nonwoven fabrics in a single integrated process. The melt-blown web is usually wound onto a cardboard core and processed further according to the end-use requirement. The combination of fiber entanglement and fiber-to-fiber bonding generally produces enough web cohesion so that the web may be readily used without further bonding. In addition, further bonding, e.g. melting to low-melt fibers, and finishing processes may further be applied to these melt-blown webs, such as cooling, and thus solidifying in a 3D structure. In some embodiments, any other suitable extrusion processes may be partially implemented.

Summarizing, low-melt fibers melted to synthetic down fibers 150 and solidified in a 3D structure try to mimic the above mentioned structure of natural down fibers 105 for improved thermal insulating properties, but may also avoid clumping when they are wet.

Figure 2:
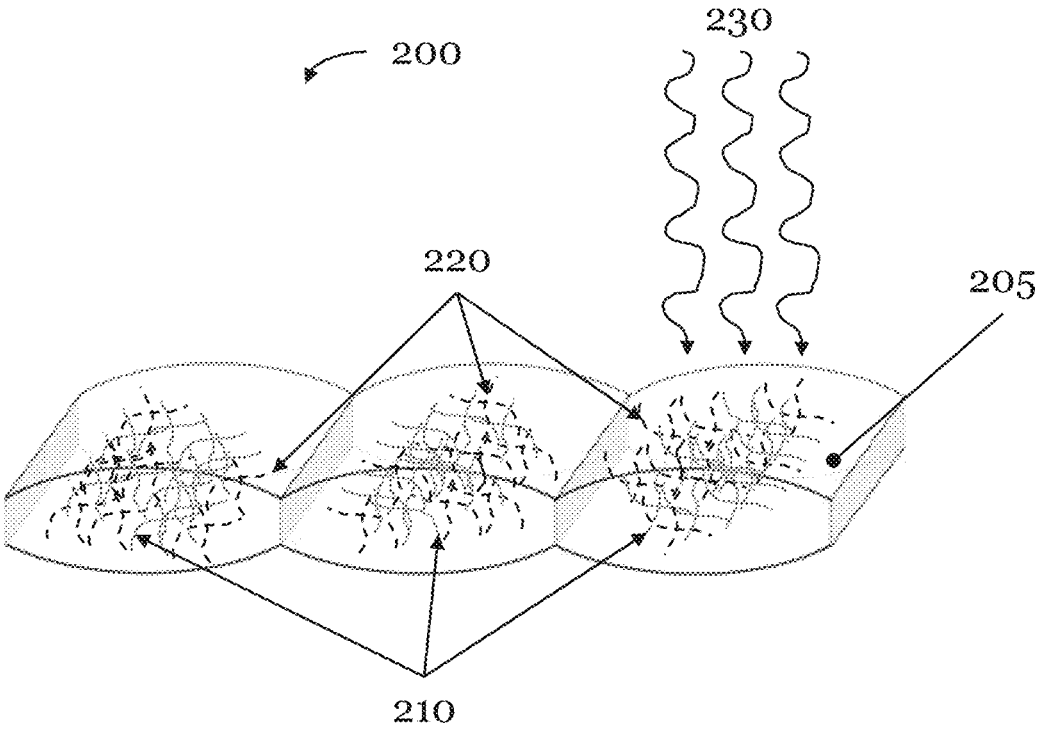
FIG. 2 is a front perspective view of a thermal insulating structure comprising at least one baffle comprising a plurality of natural and/or synthetic down fibers and a plurality of low-melt fibers according to certain embodiments of the present invention.

FIG. 2 shows embodiments of a thermal insulating structure 200 comprising at least one baffle 205, e.g. three baffles 205. They comprise a plurality of natural and/or synthetic fibers 210 and a plurality of low-melt fibers 220. The thermal insulating structure 200 may be incorporated into a jacket. FIG. 2 shows a front view of the three baffles 205 in a spatial representation.

The plurality of low-melt fibers 220 inside the three baffles 205 have been melted to the natural and/or synthetic down fibers 210 by heating inside the baffles 205. For example, the low-melt fibers 220 and the natural and/or synthetic down fibers 210 may be filled into the baffles 205, which may be then closed. Closing the baffles 205 may be performed by any suitable method such as sewing, welding, bonding, gluing, etc.

As indicated in FIG. 2, at least one baffle 205, e.g. the right baffle, may be heated by applying a melting agent 230. The melting agent 230 may comprise hot air or electromagnetic radiation. Therefore, the melting agent 230 may penetrate the baffle to melt the low-melt fibers 220 inside the baffle to the natural and/or synthetic down fibers 210. As explained above, hot air is easy to handle for the heating process inside the baffles 205. As another example, an infrared source may provide different wavelengths, for example: near-infrared, short-wavelength infrared, mid-wavelength infrared, long-wavelength infrared and far-infrared, wherein the specific wavelength to be used may be adapted depending on the materials of the low-melt fibers 220 to be melted to the natural and/or synthetic down fibers 210. A benefit of using infrared radiation is that it is easy to produce and to apply to the low-melt fibers 220 and to the natural and/or synthetic down fibers 210. The amount of heat energy may, for example, be controlled by adjusting the output power of the source, the intensity of the radiation, the size or emitted wavelength of the infrared heat source, the distances of the source to the materials, the view factor of the baffle's surface, i.e. how much of the emitted energy the baffle's surface receives, or the emissivity of the baffle's surface material, etc. Moreover, the use of infrared radiation does not impose any particular requirements, such as electrical conductivity, on the material of the fibers. It is therefore particularly suited for melting the low-melt fibers 220 to the natural and/or synthetic down fibers 210.

In the embodiments of FIG. 2, the baffles 205 comprise a baffles box construction structure. The skilled person in the art will recognize that the concept of the invention may also be used for natural and/or synthetic fibers 210 melted with low-melt fibers 210 inside other construction designs such as pockets, small boxes, sewn through baffled box design or stitch-through baffled box design.

In some embodiments, the low-melt fibers 220 may be adapted to secure the natural and/or synthetic down fibers 210 inside the baffle 205. This may be enhanced by adding an adhesive to the low-melt fibers 220.

In some embodiments, one baffle may comprise a different amount of low-melt fibers than another baffle. For example, if the baffles 205 will be used for a sleeping bag, some regions may provide better thermal insulation than other regions. In some embodiments, some regions may be stiffer than other regions in order to imitate or support a sleeping mat. This may be achieved by a higher amount of low-melt fibers 220.

In the embodiments of FIG. 2, the low-melt fibers 220 have been carded with the natural and/or synthetic down fibers into a web structure before heating inside the baffle. Moreover, the web structure may change from a loose structure to a set 3D structure by cooling the melted low-melt fibers inside the baffle.

In some embodiments, the plurality of natural and/or synthetic down fibers may comprise at least one hollow fiber. Hollow fibers may be produced by various techniques, for example by a wet spinning process. In such a process, the fiber is made from a solution of a polymer, e.g. from a solution of polyamide, by extruding the solution through a spinning nozzle around a central fluid.

In the following, further examples are described to facilitate the understanding of the invention:

Example 1

A thermal insulating structure (200), preferably a thermal insulating textile, including at least one baffle (205), the baffle comprising: a plurality of natural and/or synthetic down fibers (210); a plurality of low-melt fibers (220); wherein the low-melt fibers (220) have been melted to the natural and/or synthetic down fibers (210) by heating inside the baffle (205).

Example 2

The thermal insulating structure according to the preceding Example, wherein the low-melt fibers are adapted to secure the natural and/or synthetic down fibers inside the baffle.

Example 3

The thermal insulating structure according to any of the preceding Examples, wherein the low-melt fibers melted to the natural and/or synthetic down fibers are adapted to provide a higher thermal insulation per weight compared to synthetic down fibers.

Example 4

The thermal insulating structure according to any of the preceding Examples, wherein the low-melt fibers melted to the natural and/or synthetic down fibers are adapted to provide a higher dry compression recovery compared to synthetic down fibers.

Example 5

The thermal insulating structure according to any of the preceding Examples, wherein the low-melt fibers have been carded with the natural and/or synthetic down fibers into a web structure before heating inside the baffle.

Example 6

The thermal insulating structure according to the preceding Example, wherein the web structure has been changed from a loose structure to a set 3D structure by cooling the melted low-melt fibers inside the baffle.

Example 7

The thermal insulating structure according to any of the preceding Examples, wherein the plurality of low-melt fibers comprises low-melt core-sheath fibers.

Example 8

The thermal insulating structure according to any of the preceding Examples, wherein the plurality of low-melt fibers is provided as a filament having a linear mass density of 0.1-10 dtex, preferably 0.5-7 dtex and most preferably 1-5 dtex.

Example 9

The thermal insulating structure according to any of the preceding Examples, wherein the plurality of natural and/or synthetic down fibers comprises at least one hollow fiber.

Example 10

An article of wear comprising a thermal insulating structure according to any of the preceding Examples.

Example 11

Sleeping bag comprising a thermal insulating structure according to any of the Examples 1-9.

Example 12

A method for manufacturing a thermal insulating structure comprising the steps of: providing at least one baffle; filling a plurality of natural and/or synthetic down fibers into the baffle; filling a plurality of low-melt fibers into the baffle; and heating the fibers inside the filled baffle.

Example 13

Method according to the preceding Example, further comprising the step of mixing the plurality of natural and/or synthetic down fibers and the plurality of low-melt fibers before the filling steps.

Example 14

Method according to one of Examples 12 or 13, further comprising the step of blowing the plurality of natural and/or synthetic down fibers and the plurality of low-melt fibers with compressed air.

Example 15

Method according to one of Examples 12-14, further comprising the step of carding the plurality of natural and/or synthetic down fibers and the plurality of low-melt fibers into a web structure.

Example 16

Method according to the preceding Example, further comprising the step of disassembling the web structure.

Example 17

Method according to one of Examples 12-16, further comprising the step of cooling the heated filled baffle.

Example 18

Method according to one of Examples 12-17, wherein at least one of the filling steps is performed by a robotic device.

Example 19

The method according to one of the Examples 12-18, wherein heating comprises applying hot air.

Example 20

The method according to one of the Examples 12-19, wherein heating comprises applying electromagnetic radiation.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A thermal insulating structure comprising at least two baffle boxes, each of the at least two baffle boxes comprising:

at least two surfaces coupled at opposing edges to form a cavity within each of the at least two baffle boxes;

a plurality of at least one of natural down fibers or synthetic down fibers positioned within the cavity; and a plurality of low-melt fibers positioned within the cavity, wherein the plurality of low-melt fibers have been melted to the plurality of at least one of the natural down fibers or the synthetic down fibers by heating inside the cavity of each of the at least two baffle boxes, wherein the plurality of low-melt fibers have been carded with the plurality of at least one of the natural down fibers or the synthetic down fibers into a web structure before heating inside the cavity each of the at least two baffle boxes, wherein the melted plurality of low-melt fibers and the plurality of at least one of the natural down fibers or the synthetic down fibers form an individual three-dimensional structure within the cavity of each of the at least two baffle boxes, and wherein the at least two baffle boxes are coupled along one of the opposing edges of each of the at least two baffle boxes.

2. The thermal insulating structure according to claim 1, wherein the plurality of low-melt fibers are adapted to secure the plurality of at least one of the natural down fibers or the synthetic down fibers inside the cavity of each of the at least two baffle boxes.

3. The thermal insulating structure according to claim 1, wherein the plurality of low-melt fibers melted to the plurality of at least one of the natural down fibers or the synthetic down fibers are adapted to provide a higher thermal insulation per weight compared to synthetic down fibers.

4. The thermal insulating structure according to claim 1, wherein the plurality of low-melt fibers melted to the plurality of at least one of the natural down fibers or the synthetic down fibers are adapted to provide a higher dry compression recovery compared to synthetic down fibers.

5. The thermal insulating structure according to claim 1, wherein the web structure has been changed from a loose structure to a set 3D structure by cooling the melted plurality of low-melt fibers inside the cavity of each of the at least two baffle boxes.

6. The thermal insulating structure according to claim 1, wherein the plurality of low-melt fibers comprises low-melt core-sheath fibers.

7. The thermal insulating structure according to claim 1, wherein the plurality of low-melt fibers is provided as a filament having a linear mass density of 0.1-10 dtex.

8. The thermal insulating structure according to claim 1, wherein the plurality of at least one of the natural down fibers or the synthetic down fibers comprises at least one hollow fiber.

9. The thermal insulating structure according to claim 1, wherein the thermal insulating structure forms an article of wear.

10. The thermal insulating structure according to claim 1, wherein the thermal insulating structure forms a sleeping bag.

11. A method for manufacturing a thermal insulating structure comprising the steps of:

forming at least one baffle box;

filling a plurality of at least one of natural down fibers or synthetic down fibers into the baffle box;

filling a plurality of low-melt fibers into the baffle box;

carding the plurality of at least one of the natural down fibers or the synthetic down fibers and the plurality of low-melt fibers into a web structure before heating inside the baffle box; and heating the fibers inside a filled baffle box.

12. The method according to claim 11, further comprising the step of mixing the plurality of at least one of the natural down fibers or the synthetic down fibers and the plurality of low-melt fibers before filling the baffle box.

13. The method according to claim 11, further comprising the step of blowing the plurality of at least one of the natural down fibers or the synthetic down fibers and the plurality of low-melt fibers with compressed air.

14. The method according to claim 11, further comprising the step of disassembling the web structure.

15. The method according to claim 11, further comprising the step of cooling the heated filled baffle box.

16. The method according to claim 11, wherein at least one of the filling steps is performed by a robotic device.

17. The method according to claim 11, wherein heating comprises applying hot air.

18. The method according to claim 11, wherein heating comprises applying electromagnetic radiation.

* * * * *